US005488337A

United States Patent [19]

Hubbard et al.

[11] Patent Number: 5,488,337

[45] Date of Patent: Jan. 30, 1996

[54] CIRCUIT BREAKER WITH DISTRIBUTION LUG TERMINAL HAVING TRAPPED INSULATOR

[76] Inventors: Dean A. Hubbard, N70 W23395 Prides Rd., Sussex, Wis. 53089; Donald A. Link, 1155 Hubertus, Hubertus, Wis. 53033; David S. Hunter, 11907 W. Appleton Ave., Milwaukee, Wis. 53224

[21] Appl. No.: 102,190

[22] Filed: Aug. 5, 1993

[51] Int. Cl.[6] ..... H01H 67/02

[52] U.S. Cl. ..... 335/202; 335/8

[58] Field of Search ..... 335/8–10, 167–176, 335/202, 132

[56] References Cited

U.S. PATENT DOCUMENTS

| | | | |
|---|---|---|---|
| 2,654,815 | 10/1953 | Laverty | 200/144 |
| 3,238,329 | 3/1966 | Russo | 335/132 |
| 4,809,132 | 2/1989 | Palmieri et al. | 335/202 |
| 4,975,667 | 12/1990 | Morgan et al. | 361/353 |
| 5,117,211 | 5/1992 | Morgan et al. | 335/202 |

OTHER PUBLICATIONS

Technical Information Publication TK, dated Oct. 1, 1992.

DU–211, CH20M, Cutler–Hammer Power Distribution Products Flyer Oct., 1992.

Square D "Digest", Dec. 1992, cover and p. 5–31 Circuit Breakers, Molded Case–Lugs.

*Primary Examiner*—Lincoln Donovan

[57] ABSTRACT

A molded insulator has a bottom wall, opposed sidewalls, and a transverse end wall extending between the sidewalls but spaced from the end of the bottom wall to define an opening in the bottom. A distribution lug is inserted from an open end of the insulator against the end wall, and under projections on inner surfaces of the sidewalls to trap the insulator against the end wall, and under projections on inner surfaces of the sidewalls to trap the insulator against up and down movement. The lug is attached to a circuit breaker terminal at the opening in the bottom to trap the end wall between the lug and the circuit breaker, blocking withdrawal of the insulator. A depending rib provides distal end support, while lateral ribs abut edges of barriers in the breaker housing to maintain the assembly properly aligned for electrical spacing.

24 Claims, 2 Drawing Sheets

CIRCUIT BREAKER WITH DISTRIBUTION LUG TERMINAL HAVING TRAPPED INSULATOR

BACKGROUND OF THE INVENTION

This invention relates to molded case circuit breakers and particularly to distribution lug terminals used thereon. Still more particularly, this invention relates to insulators covering the distribution lugs, trapped to the circuit breaker by attachment of the distribution lug to the circuit breaker terminal.

It is known to provide a power distribution wiring connector or lug on the load terminal of a molded case circuit breaker. These wiring lugs have multiple wire-receiving openings in an end face. The openings are individually intersected by threaded openings which intersect the wire-receiving openings at right angles. Set screws in the threaded openings project into the wire-receiving openings to clamp a wire in a respective opening. This distribution lug permits power through the circuit breaker to be distributed to multiple load devices from the same terminal, eliminating a separate terminal block assembly otherwise provided for this purpose. However, because multiple connection points are provided on the lug, the set screws are staggered or arranged in step fashion to enable a respective set screw to intersect only a single wire-receiving opening. Such arrangement increases the length of the distribution lug over that of a single wire lug normally provided with the molded case circuit breaker. The extended-length distribution lug, when attached to the circuit breaker terminal, extends beyond the end of many circuit breaker molded cases and beyond insulating barriers of the molded case that are disposed between the terminals. Accordingly, the extending distribution lugs require insulators to protect against phase-to-phase short circuit and inadvertent contact with the lugs.

It is known to provide a molded insulating terminal cover which attaches to and becomes an extension of the circuit breaker molded case to provide an insulating covering for the extended-length distribution lug terminals. Molded insulating lug covers require the circuit breaker molded case to be suitably configured with cooperative attachment features to receive the molded such attachment features molded into the members of the molded case and therefore cannot readily receive a retrofit molded insulating terminal cover.

Summary of the Invention

This invention provides a distribution lug for a terminal of a molded case circuit breaker and an insulator member covering the distribution lug. The insulator member is trapped to the lug and terminal by attachment of the lug to the terminal. The insulator is a channel-like member having a U-shaped cross section and having a length greater than the length of the distribution lug. A bottom wall of the insulator is open at one end for direct attachment of the distribution lug to the circuit breaker terminal. A transverse wall or a pair of opposed transverse projections at the one end of the insulator engages an end of the distribution lug to block outward movement of the insulator away from the circuit breaker case when the distribution lug is secured to the breaker terminal. A pair of inwardly directed projections on inner surfaces of the legs of the insulator engage a top-facing surface of the distribution lug and cooperate with the bottom wall of the insulator to prevent up and down movement of the insulator relative to the distribution lug. A rib or other suitable projection depends from the bottom wall of the insulator to substantially lower the plane of the mounting surface of the circuit breaker molded case to provide support for the distal end of the distribution lug. A pair of lateral projections on outer surfaces of the legs of the insulator abut inner edges of insulating barriers on the circuit breaker molded case to maintain the distribution lug and insulator properly aligned to provide proper electrical spacing. The insulator covers two sides and the bottom of the connector lug and extends beyond the distal end and above the upper surfaces of the lug to afford phase-to-phase contact protection at the top and end surfaces. The invention, its features and advantages, will become apparent in the following description and claims when read in conjunction with the accompanying drawings.

DETAILED DESCRIPTION OF THE PREFERRED EMBODIMENT

Figure 1:
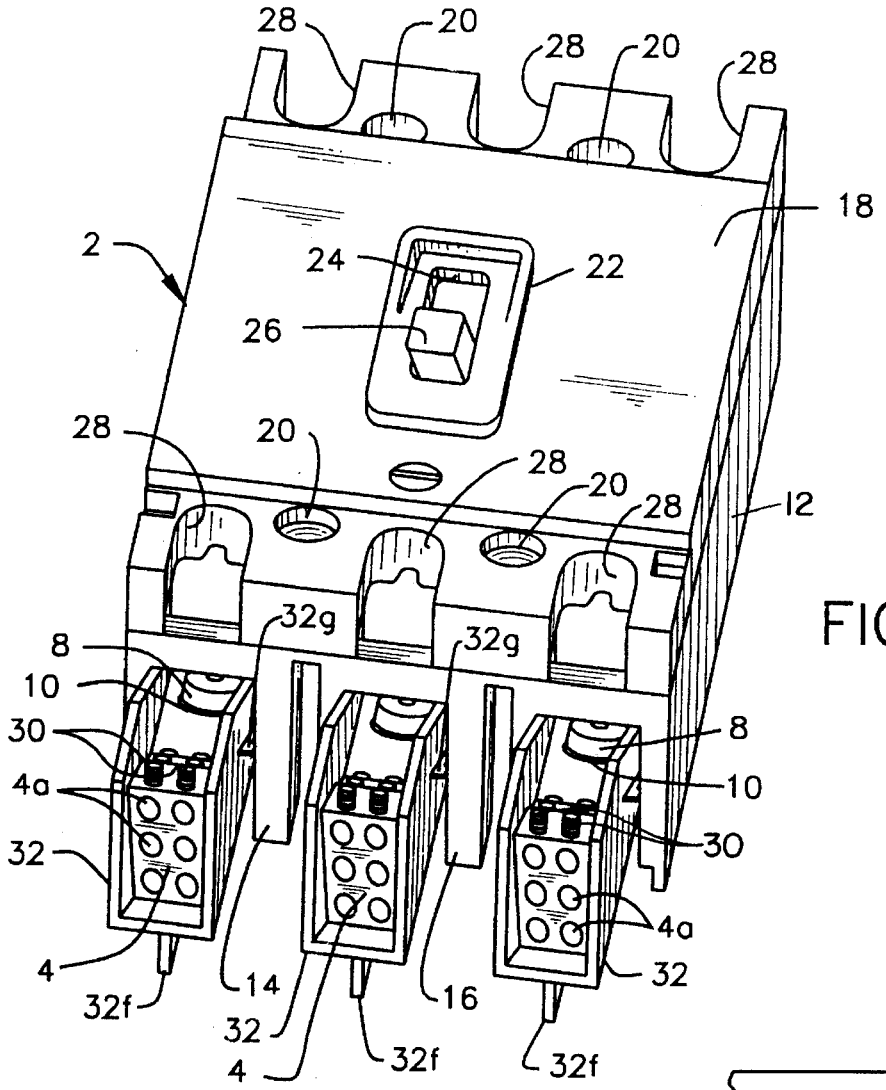
FIG. 1 is a perspective view of a molded case circuit breaker having the distribution lug and insulator of this invention assembled thereto.

Referring to the drawings, a molded case circuit breaker 2 is shown in FIG. 1 having power distribution lugs 4 attached to the load terminals 6 (FIG. 5) by screws 8 and lock washers 10. Circuit breaker 2 may be of the type disclosed in U.S. Pat. No. 4,080,582 issued Mar. 21, 1978 to Donald A. Link and assigned by mesne assignments to the assignee of this application. Reference may be had to that patent for a more complete understanding of the circuit breaker. Circuit breaker 2 comprises a molded insulating case comprising a molded base 12 which has three openings at each end through which the terminals 6 project at one end of the breaker designated the "load" end. The opposite end of the breaker also has terminals (not shown) projecting through the openings for attachment of line power conductors to the terminals. The side walls of base 12 extend beyond the end wall in which the openings are located to provide a side barrier for the terminal plates such as 6. A pair of intermediate walls 14 and 16 extend parallel to the side walls of base 12 between the center pole of the breaker and the respective outer poles to provide a barrier between the terminal plates in their respective poles.

Figure 2:
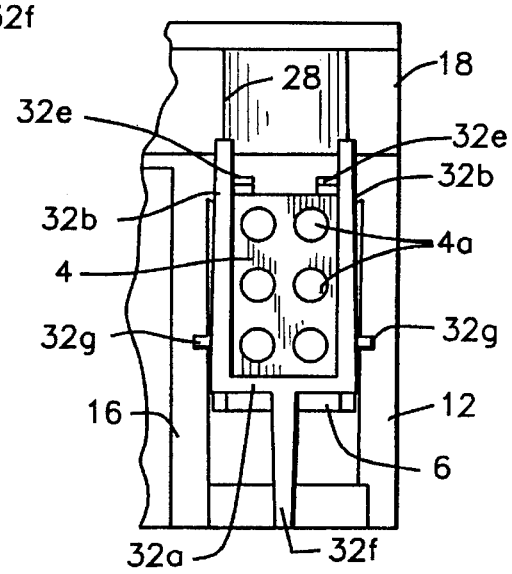
FIG. 2 is an end elevational view of one pole of the molded case circuit breaker of FIG. 1 showing the distal end of the distribution lug and insulator of this invention.
Figure 5:
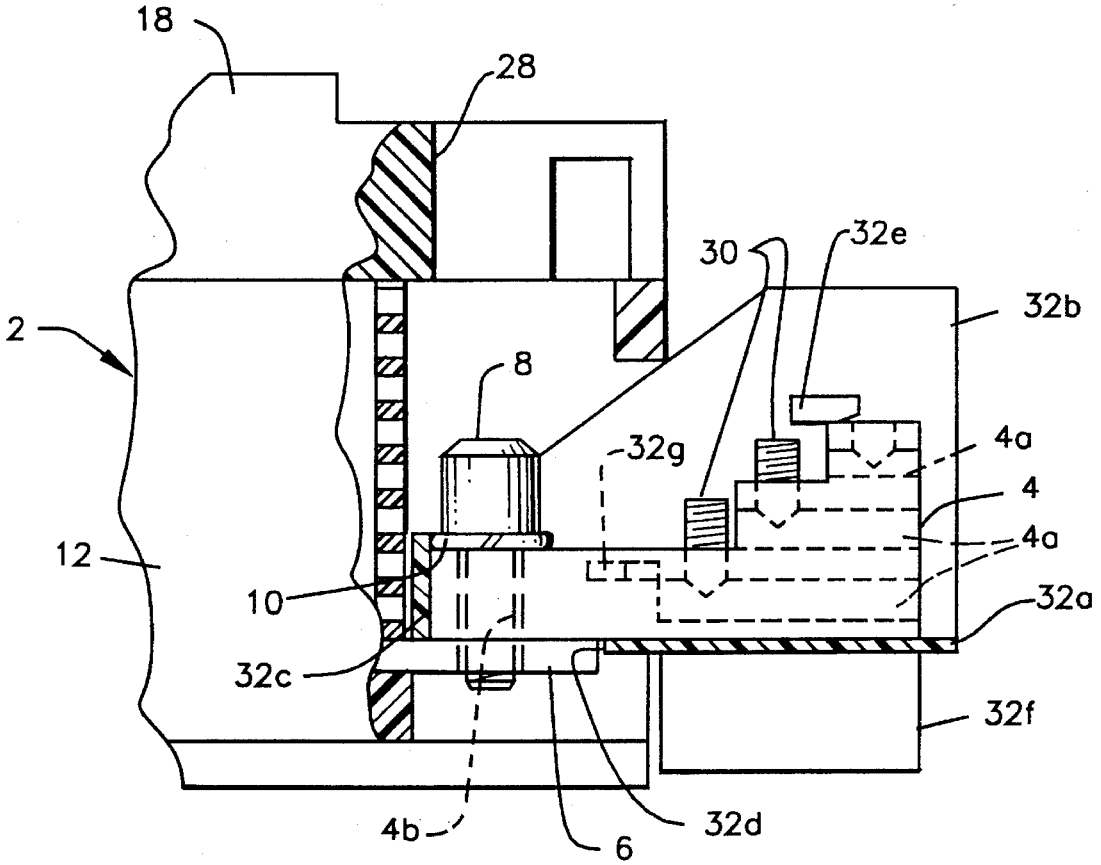
FIG. 5 is a side-elevational view of the distribution lug and insulator of this invention attached to a terminal of one pole of a molded case circuit breaker as shown in FIG. 4, but showing the insulator in cross section.

The molded case of circuit breaker 2 also comprises a molded insulating cover 18 which is secured over an open upper end of the base 12 by four rivets which pass through holes 20 in cover 18 and correspondingly aligned holes in base 12. Cover 18 is provided with a central island 22 having an opening 24 through which an operating handle 26 of the circuit breaker mechanism projects. The opposite ends of cover 18 are provided with openings 28 which are aligned with the respective poles of the circuit breaker to provide tool access to the terminal lug set screw or, in the case of this invention, to the screw 8 which secures the distribution lug 4 to the terminal 6. The distribution lug 4 shown in the drawings has provision for attaching six wires thereto. As seen particularly in FIG. 5, the distribution lug is an elongated bar having a stepped distal end to present an enlarged distal surface or face. Six wire-receiving holes 4*a* are provided in the bar from the distal face, arranged in horizontally aligned pairs. A pair of threaded holes are provided in the upper surface of each step to intercept the wire-receiving holes 4*a* at right angles. Set screws 30 are provided in the threaded holes to extend into the respective wire-receiving holes and clamp a wire within the respective hole 4*a*. In FIGS. 2 and 5, the set screws 30 in the upper step of the distribution lug 4 have been omitted so as not to obscure other details of the invention. The inner end of distribution lug 4 opposite the distal end is provided with a hole 4*b* (FIG. 5) therethrough extending from top to bottom which is a clearance hole for the screw 8.

Figure 3:
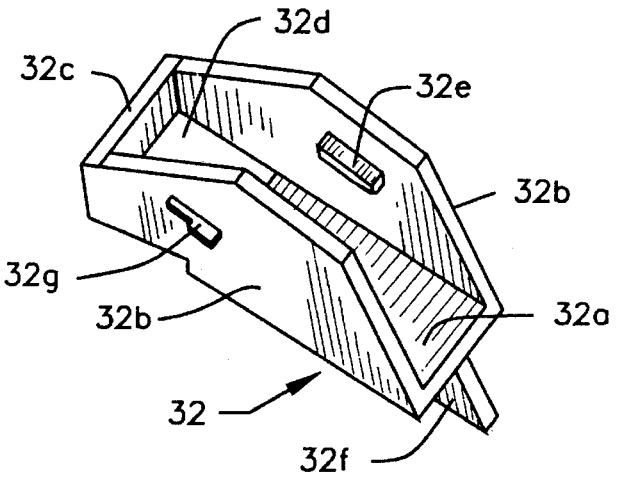
FIG. 3 is a perspective view of the insulator of this invention.
Figure 4:
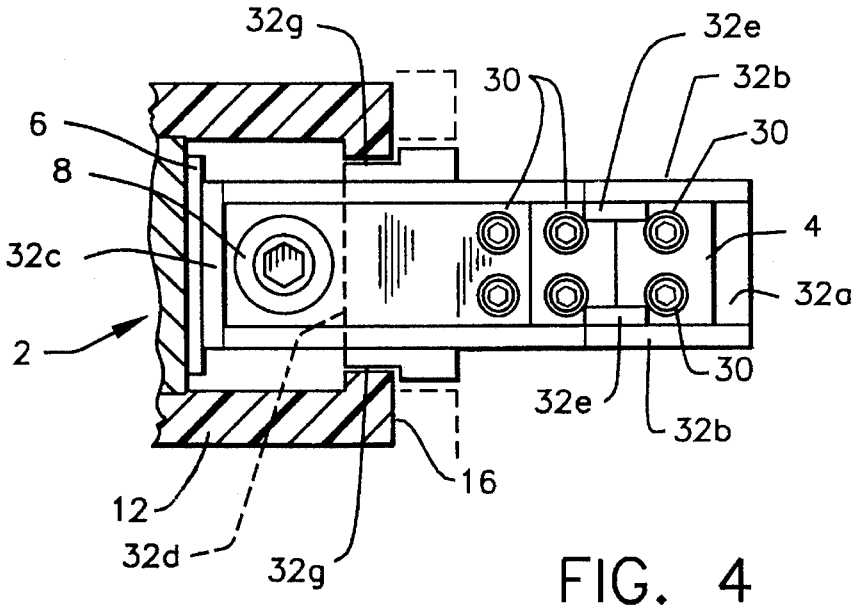
FIG. 4 is a top-plan view of the distribution lug and insulator of this invention attached thereto and shown assembled to a terminal of one pole of a molded case circuit breaker.

The insulator 32 of this invention is shown in isometric view in FIG. 3. It is a molded plastic member having a U-shaped cross section comprising a bottom wall 32*a* and upstanding side walls 32*b* joined to the bottom wall 32*a* at the opposite lateral edges thereof. Side walls 32*b* extend beyond the left-hand end of bottom wall 32*b* as viewed in FIG. 3 and are joined together by a transverse end wall 32*c* to define an opening 32*d* in the bottom of the insulator. A pair of inwardly extending projections 32*e* are provided on the inner surfaces of the upstanding side walls 32*b* of the insulator. The outermost end of the projections 32*e* is chamfered along the bottom edge to facilitate insertion of the distribution lug 4 therein. As seen in FIGS. 2,4 and 5, the projections engage the upper surface of a step of the distribution lug 4 when the distribution lug is fully inserted to the end wall 32*c* of the insulator. The projections 32*e* and bottom wall 32*a* hold the insulator against the distribution lug 4 relative to up and down motion. Lug 4, with insulator 32 disposed thereon, is attached to the circuit breaker terminal 6 with screw 8 threadably engaging a tapped hole in the terminal. As seen best in FIG. 5, transverse wall 32*c* is trapped between the inner end of lug 4 and an end wall of the circuit breaker 2 to block outward movement of insulator 32 and trap the insulator on the lug. In place of wall 32*c*, a pair of inwardly directed projections on the side walls 32*b* could be used to provide the same engagement with the end wall of breaker 2 and the end of lug 4. An elongated rib 32*f* depends from bottom wall 32*a* to substantially the mounting plane of circuit breaker 2 to provide support for the distal end of lug 4 when mounted to a panel. A pair of stepped lateral ribs 32*g* are provided on outer surfaces of side walls 32*b* to abut the sides of the barriers and end walls of breaker molded case 12 to maintain the lug 4 and insulator 32 properly aligned as seen in FIG. 4. The wider portions of ribs 32*g* are provided to enable the insulator to be used with a second size circuit breaker as represented by the dotted lines in FIG. 4.

Thus it will be appreciated that this invention provides an insulator for a distribution lug used on a molded case circuit breaker wherein the extended length of the distribution lug causes it to project beyond the molded case barriers and sidewalls. The insulator is inexpensively molded and readily installed. It extends beyond the distal end of the respective distribution lug and above the uppermost surface thereof to greatly reduce accidental contact between adjacent lugs by a tool or the like. Although the distribution lug and insulator assembly of this invention are shown and described in the best mode contemplated for carrying out the invention, it is to be understood that they are susceptible to various modifications without departing from the scope of the appended claims.

We claim:

1. A molded case circuit breaker comprising a molded case, a terminal and a wiring lug attached to said terminal, said lug projecting outwardly from said circuit breaker molded case, and an insulator discrete from said molded case disposed around said lug and trapped into said circuit breaker molded case by attachment of said lug to said terminal.

2. The molded case circuit breaker defined in claim 1 wherein said insulator comprises a U-shaped member having a bottom wall disposed under said lug and sidewalls connected with said bottom wall extending along opposite sides of said lug, a portion of said bottom wall being omitted proximate said terminal for direct attachment of said lug to said terminal.

3. The molded case circuit breaker defined in claim 2 wherein said sidewalls comprise transverse means disposed between said circuit breaker molded case and said lug limiting inward and outward movement of said insulator.

4. The molded case circuit breaker defined in claim 3 wherein said sidewalls comprise transversely directed projections on inner surfaces thereof engaging said lug, said projections and said bottom wall limiting up and down movement of said insulator relative to said lug.

5. The molded case circuit breaker defined in claim 4 wherein said lug is slidably inserted into said insulator along said bottom wall until said lug abuts said transverse means prior to attachment of said lug to said terminal.

6. The molded case circuit breaker defined in claim 5 wherein said lug slidably engages said transversely directed projections prior to abutting said transverse means.

7. The molded case circuit breaker defined in claim 6 wherein said insulator comprises support means depending below said bottom wall to a level substantially co-planar with a lower surface of said circuit breaker molded case.

8. The molded case circuit breaker defined in claim 7 wherein said support means comprises a rib depending from said bottom wall.

9. A circuit breaker having a molded insulating case, a plurality of openings in one end of said case, a plurality of electric terminal plates extending through said openings, and insulating barriers on said one end of said case disposed on opposite sides of each said terminal plate; wherein the improvement comprises a plurality of distribution lugs, each of said distribution lugs comprising one end attached to a respective said terminal plate and a distal end extending beyond said insulating barriers, said distal end comprising a plurality of wire connecting means; and, a plurality of insulators, said insulators being disposed on respective ones of said distribution lugs to cover opposite sides of said distribution lug beyond said insulating barriers.

10. The circuit breaker defined in claim 9 wherein said insulator extends outward from said case beyond said distal end of said distribution lug.

11. The circuit breaker defined in claim 9 wherein said insulator extends above said distribution lug at said opposite sides.

12. The circuit breaker defined in claim 9 wherein said insulator comprises a bottom wall and opposite sidewalls extending from said bottom wall, said sidewalls covering said opposite sides of said distribution lug and said bottom wall covering a portion of a bottom of said distribution lug, said bottom wall being spaced outwardly from said terminal plate.

13. The circuit breaker defined in claim 9 wherein said insulator comprises support means depending substantially to a plane containing a lower surface of said case.

14. The circuit breaker defined in claim 12 wherein said insulator comprises support means depending from said bottom wall substantially to a plane containing a lower surface of said case.

15. The circuit breaker defined in claim 12 wherein said insulator comprises means engaging said one end of said distribution lug for blocking movement of said insulator outwardly along said terminal plate.

16. The circuit breaker defined in claim 12 wherein said insulator comprises means engaging said distribution lug proximate said distal end for cooperating with said bottom wall to secure said insulator against up and down movement relative to said distribution lug.

17. The circuit breaker defined in claim 12 wherein said insulator comprises lateral ribs on opposite outer surfaces of said sidewalls, said ribs engaging inner surfaces of said barriers for maintaining alignment of said insulator and said distribution lug with said barriers.

18. The circuit breaker defined in claim 12 wherein said insulator comprises first and second lateral ribs on opposite outer surfaces of said sidewalls, said second lateral ribs being disposed farther from said case and having a greater transverse dimension than said first lateral ribs, said first lateral ribs engaging inner surfaces of said barriers for maintaining alignment of said insulator and said distribution lug with said barriers of a circuit breaker of one size, said second lateral ribs being disposed outwardly beyond said barriers, and said second lateral ribs engaging inner surfaces of said barriers of a circuit breaker of a second size larger than said one size for maintaining alignment of said insulator and said distribution lug with said barriers of said second size circuit breaker.

19. The circuit breaker defined in claim 12 wherein said insulator comprises first and second transverse means projecting from inner surfaces of said sidewalls, said first transverse means cooperating with said bottom wall for restricting up and down movement of said insulator relative to said distribution lug and said second transverse projections engaging said one end of said distribution lug for blocking outward movement of said insulator relative to said distribution lug, said insulator being non-removably trapped into said circuit breaker case and said distribution lug upon attachment of said distribution lug to said terminal plate.

20. The circuit breaker defined in claim 19 wherein said second transverse projections comprise a transverse wall extending between said sidewalls at an interior end of said insulator proximate said one end of said distribution lug.

21. The circuit breaker defined in claim 20 wherein said transverse wall abuts said circuit breaker case for limiting movement of said insulator inwardly relative to said distribution lug.

22. The circuit breaker defined in claim 12 wherein said bottom of said distribution lug is compressively fastened against an upper surface of said terminal plate, and said portion of said bottom of said distribution lug thereby applies a force upon said bottom wall of said insulator, securing said insulator to said distribution lug.

23. A method of providing an electrical distribution lug attached to a terminal plate of a molded case circuit breaker comprising the steps of:

providing a distribution lug with a mounting hole at one end and a plurality of wire connection means at a distal end;

providing a U-shaped insulator comprising a bottom wall, upstanding sidewalls connected to lateral edges of said bottom wall, transverse means projecting from inner surfaces of said sidewalls at one end of said insulator, and an opening in said bottom wall at said one end of said insulator;

inserting said distribution lug into said insulator so that said lug rests against said bottom wall and said one end of said lug abuts said transverse means on said insulator; and fastening said one end of said lug against an upper surface of said terminal plate, thereby trapping said insulator to said lug and into said circuit breaker case.

24. The method of providing an electrical distribution lug on a terminal plate of a molded case circuit breaker defined in claim 15 wherein the step of inserting said distribution lug into said insulator comprises the steps of:

aligning a bottom surface of said distribution lug with a top surface of said bottom wall at an end of said insulator opposite said one end thereof;

providing second transverse means projecting from inner surfaces of said sidewalls at said opposite end of said insulator at a spaced distance from said bottom wall;

sliding said distribution lug along said bottom wall until said one end of said distribution lug abuts said transverse means at said one end of said insulator and said distal end of said distribution lug slides under said second transverse projections at said opposite end of said insulator.

* * * * *